US006186902B1

(12) United States Patent
Briggs

(10) Patent No.: US 6,186,902 B1
(45) **Date of Patent: *Feb. 13, 2001**

(54) PARTICIPATORY WATER SLIDE PLAY STRUCTURE

(75) Inventor: Rick A. Briggs, Springfield, IL (US)

(73) Assignee: Koala Corp., Denver, CO (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/914,672

(22) Filed: Aug. 19, 1997

Related U.S. Application Data

(60) Provisional application No. 60/045,406, filed on May 1, 1997.

(51) Int. Cl.[7] ..... A63G 21/18

(52) U.S. Cl. ..... 472/117; 472/128

(58) Field of Search ..... 472/116, 117, 472/128, 137, 88; 104/53, 69, 70, 73

(56) References Cited

U.S. PATENT DOCUMENTS

| | | | |
|---|---|---|---|
| 1,648,196 | 11/1927 | Rohmer . | |
| 3,539,181 | 11/1970 | Larsen . | |
| 4,057,244 | 11/1977 | Gaspar . | |
| 4,145,042 | 3/1979 | Becker et al. . | |
| 4,149,710 | 4/1979 | Rouchard . | |
| 4,194,733 | 3/1980 | Whitehouse, Jr. . | |
| 4,196,900 | 4/1980 | Becker et al. . | |
| 4,573,679 | 3/1986 | Janszen . | |
| 4,799,665 | 1/1989 | Bracy . | |
| 4,805,897 | 2/1989 | Dubeta . | |
| 4,805,898 | 2/1989 | Jacober et al. . | |
| 5,011,134 | 4/1991 | Langford . | |
| 5,194,048 | 3/1993 | Briggs . | |
| 5,213,547 | 5/1993 | Lochtefeld . | |
| 5,288,071 | 2/1994 | Solomon . | |
| 5,378,197 | 1/1995 | Briggs . | |
| 5,405,294 | 4/1995 | Briggs . | |
| 5,662,525 | 9/1997 | Briggs . | |
| 5,685,778 * | 11/1997 | Sheldon et al. | 472/43 |

FOREIGN PATENT DOCUMENTS

| | | |
|---|---|---|
| 1 031 693 | 6/1958 | (DE) . |
| 3812-435 | 9/1989 | (DE) . |

* cited by examiner

*Primary Examiner*—Kien T. Nguyen
(74) *Attorney, Agent, or Firm*—Knobbe, Martens, Olson & Bear LLP

(57) ABSTRACT

A participatory water slide play apparatus is disclosed upon which a ride participant can slide from an upper portion to a lower portion. Sensor/actuator devices are positioned on or adjacent the slide at locations intermediate the upper and lower portions thereof and are linked to associated play elements, such as water forming elements, noise making devices, scoring devices, and the like. While traveling down the slide, the ride participant is able to actuate one or more of the sensor/actuator devices to trigger one or more associated play elements and/or effects. Thus, aside from the enjoyment of the ride itself, ride participants can bring about desired effects and/or actively participate or interact with other ride participants located on or around the slide play structure in a fun and exciting manner.

43 Claims, 13 Drawing Sheets

PARTICIPATORY WATER SLIDE PLAY STRUCTURE

This application claims benefit to Provisional application No. 60/045,406, filed May 1, 1997.

BACKGROUND OF THE INVENTION

1. Field of the Invention

The present invention relates generally to the field of commercial play structures and, in particular, to water slide play structures.

2. Description of the Related Art

The popularity of family-oriented theme parks and commercial recreational facilities has increased steadily in the last decade. Water parks, in particular, have proliferated as adults and children alike seek the thrill and entertainment of water attractions as a healthy and enjoyable way to cool off in the hot summer months.

Water parks typically incorporate a variety of different water attractions. One of the most popular water attractions is the water slide. Commercial water slides typically include a riding surface and a plurality of water outlets at the upper entrance portion thereof for admitting water directly onto the riding surface. The water on the riding surface provides a lubricant, reducing friction between the ride participant and the riding surface. Additional water outlets may be interspersed at intervals along the length of the slide, as desired, to provide additional lubricant and/or to accelerate or decelerate the ride participant, as desired. The pull of gravity and/or water acceleration propels the ride participant from one end of the slide to the other. The ride participant typically exits the ride at the end by splashing into a receiving pool.

A climbing structure or stairway is typically provided adjacent the slide to enable ride participants to ascend to the entrance of the slide, usually the uppermost portion. Typically, only one person at a time is able to slide down the slide; others are either climbing the stairs to the top and/or waiting in an adjacent queuing area for their turn to ride down the water slide. Due to the popularity of these rides, queuing areas often extend down the climbing structure and participants may be forced to wait up to 20 minutes or more for their turn to slide down the riding surface. The extended waiting time is a common complaint among ride participants since the ride itself only lasts less than about a minute.

To help alleviate these problems and to create a more exciting water slide experience my U.S. Pat. No. 5,378,197 first disclosed the concept of a participatory water slide play structure in which various water forming devices are positioned over the slide for expelling water onto play participants as they slide down the slide. The devices are arranged such that they can be actuated by the play participants waiting in line or ascending the adjacent climbing structure. It was found that by providing activities for persons waiting in line, their attention was diverted from the tiresome wait and they were able to enjoy and even look forward to their turn in line.

While this generally improved the morale of those play participants waiting in line, the slide experience itself remained largely "passive"—that is, the play participants sliding down the slide (sometimes referred to herein as "ride participants") could not interact with the ride or other play participants once they began their descent down the riding surface. As a result, these ride participants often became the passive "victims" of other play participants controlling the various water forming elements. The slide experience for many of these ride participants often became a hapless ride through a gauntlet of water sprays, jets and water falls with no means to avoid being targeted or to fight back.

SUMMARY OF THE INVENTION

The present invention expands and improves on my earlier concepts by giving ride participants the ability to "fight back" or interact with the slide and/or other play participants in a fun and educational way. Among other things the present invention enables ride participants to take an active role in creating various desired play effects and/or interacting with other play participants or persons waiting in line. The result is a more enjoyable experience for both the play participants sliding down the slide and those waiting in line.

To achieve these and other objects and advantages, the present invention, in one embodiment, provides a number of uniquely adapted sensor/actuator devices which can be actuated by play participants sliding down the slide to activate one or more associated play effects, such as various water forming devices. Such sensor/actuator devices may include, for example, noncontact sensors such as photo sensors or light beam sensors (e.g., visible light, ultra-violet and infra-red beams), audio sensors (e.g., clap detectors or ultrasonic sensors), field sensors (e.g., tag devices), target sensors (e.g., watergun targets, foam ball targets, flying disk targets, baskets), and contact sensors (e.g., trip wires, weight sensors, flipper triggers, and direct contact targets).

In accordance with another embodiment, the present invention provides a slide play structure comprising a riding surface upon which play participants can slide, one or more play elements, such as water forming elements, for creating desired effects and/or for attaining a desired goal, and one or more sensor/actuators disposed on or adjacent the riding surface for actuating one or more of the play effects as the play participants slide along the riding surface.

In accordance with another embodiment, the present invention provides a participatory water slide play structure comprising a riding surface upon which a first group of one or more play participants can slide from a entrance point to an exit point, a support structure disposed adjacent the riding surface adapted to support a second group of one or more play participants, the support structure being sized and configured such that the second group of play participants can view the first group of play participants as they slide along the riding surface, and one or more water forming elements, such as spray nozzles, adapted to be actuated by the first group of play participants as they slide along the riding surface for creating desired water effects and/or for spraying water onto the second group of play participants whereby the first group of play participants can actively engage in various participatory activities as they slide along the riding surface.

In accordance with another embodiment, the present invention provides a two-way participatory water slide play structure comprising a riding surface upon which a first group of one or more play participants can slide from a entrance point to an exit point, a support structure disposed adjacent the riding surface adapted to support a second group of one or more play participants, the support structure being sized and configured such that the second group of play participants can view the first group of play participants as they slide along the riding surface, one or more first water forming elements adapted to be actuated by the first group of play participants as they slide along the riding surface for creating desired water effects and/or for spraying water onto the second group of play participants, and one or more second water forming elements adapted to be actuated by the second group of play participants for creating desired water effects and/or for spraying water onto the first group of play participants as they slide along the riding surface whereby the first and second groups of play participants can interact with one another by actuating the various water forming elements disposed in, on or around the water slide play structure.

In accordance with another embodiment, the present invention provides a participatory water slide play structure comprising a riding surface upon which play participants can slide, one or more water forming elements, such as spray nozzles or water guns, for creating desired water effects and/or for spraying water onto other play participants, and one or more sensor/actuator devices disposed on or adjacent the riding surface for activating one or more of the water effects as the play participants slide along the riding surface.

In accordance with another embodiment, the present invention provides an actuator for allowing play participants sliding along a riding surface to selectively actuate one or more associated effects, comprising a sensor/actuator device, such as a contact actuator, adapted to be actuated by a play participant sliding along the riding surface, the sensor/actuator being adapted, when actuated, to generate an actuating signal, and means for receiving the actuating signal to control one or more associated effects whereby the actuator enables play participants to actively engage in various participatory activities as they slide along the riding surface.

These and other features and advantages of the invention will be readily apparent to persons skilled in the art from the following detailed description of the preferred embodiments having reference to the accompanying drawings, the invention not being limited to any particular preferred embodiment disclosed.

DETAILED DESCRIPTION OF THE PREFERRED EMBODIMENTS

Figure 1:
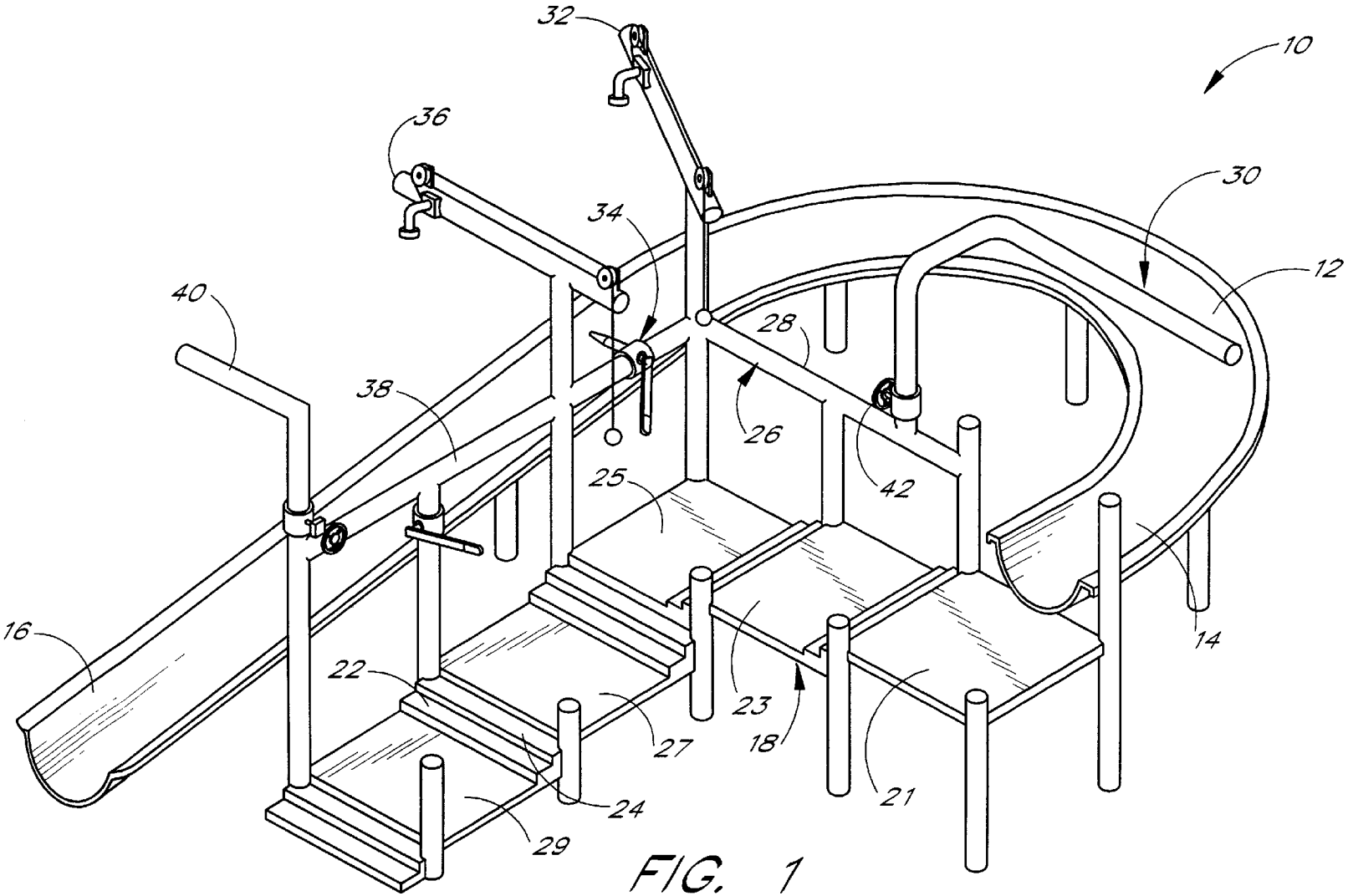
FIG. 1 (PRIOR ART)
FIG. 1 is a perspective view of a participatory water slide play structure in accordance with my previous patent U.S. Pat. No. 5,378,197.

FIG. 1 is a perspective view of a participatory water slide play structure 10 in accordance with my previous patent U.S. Pat. No. 5,378,197. As illustrated, the water slide play structure 10 basically comprises an inclined riding surface 12 having an upper entrance portion 14 and a lower exit portion 16. An adjacent platform or climbing structure 18 is provided having a plurality of platform levels 21, 23, 25, 27, 29. Climbing structure 18 is supported by a supporting framework, which, in this case, includes a pipe 28 carrying water under pressure. Each platform level is connected by a series of steps, such as steps 22 and 24 between levels 27 and 29, to permit play participants to ascend the climbing structure 18 from the lowest level 29 to the highest level 21, to enable the play participants to enter the upper entrance portion 14 of the water slide 10.

Various water forming devices 30, 32, 34, 36, 38, 40 are positioned over the riding surface 12 for expelling water onto ride participants (not shown) sliding down the slide. The water forming devices, including bar jets 30, spray jet 32, water gun 34, solid-stream jet 36, arch jets 38 and pipe falls 40, are arranged such that they can be actuated by play participants on the climbing structure 18 to spray water onto other play participants sliding down the riding surface 12.

Figure 2:
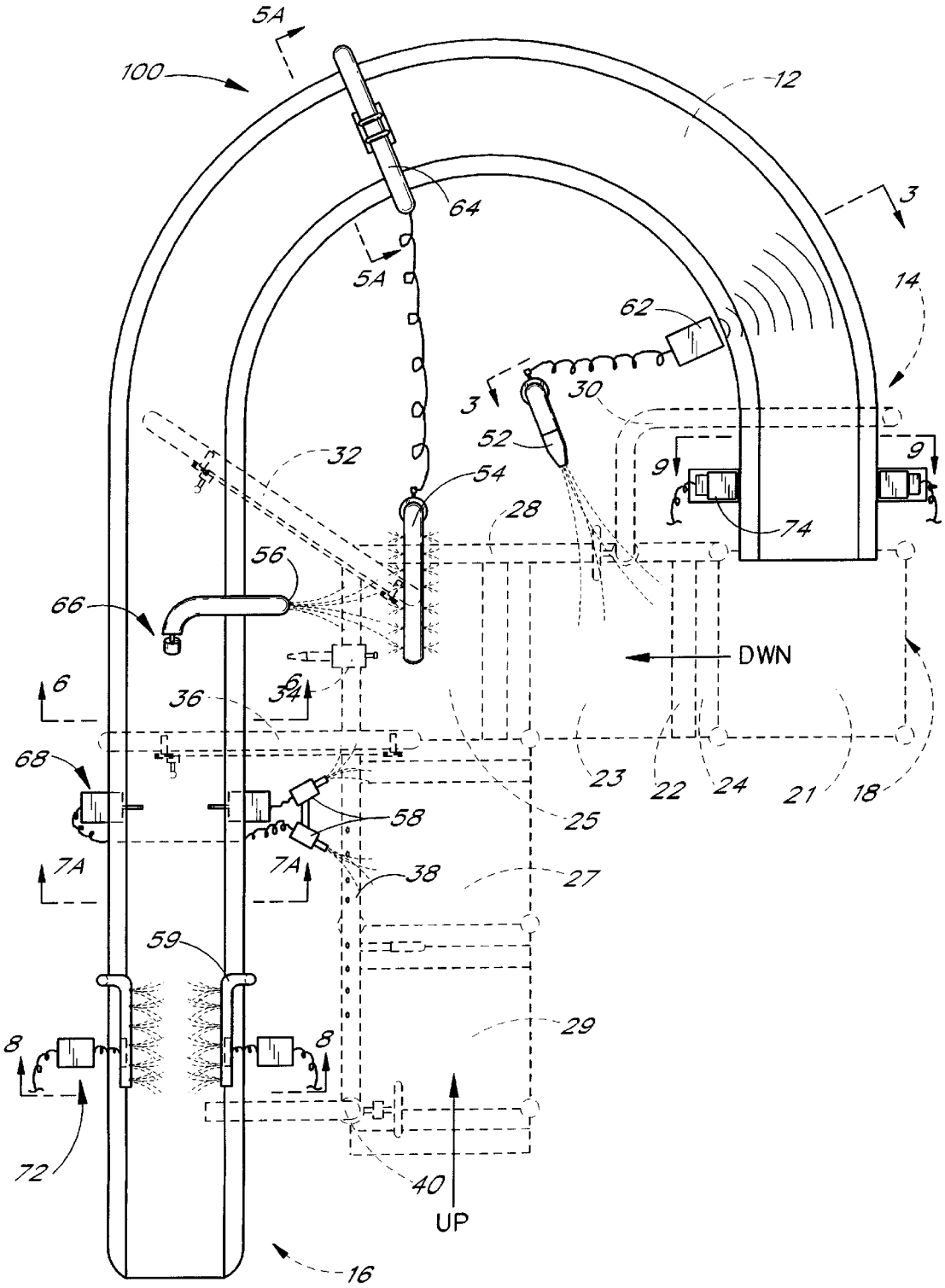
FIG. 2 is a top plan view of a participatory water slide play structure having features in accordance with the present invention.

FIG. 2 is a top plan view of an improved participatory water slide play structure 100 having features and advantages in accordance with the present invention. The particular water slide splay structure 100 shown is of a simplified design for illustrative purposes only. The riding surface 12 has a uniform slope and a single 180 degree turn, as shown. Those skilled in the art will readily appreciate, however, that the present invention may be implemented in accordance with a wide variety of other possible slide designs having longer and/or more complex riding surface configurations.

Figure 3:
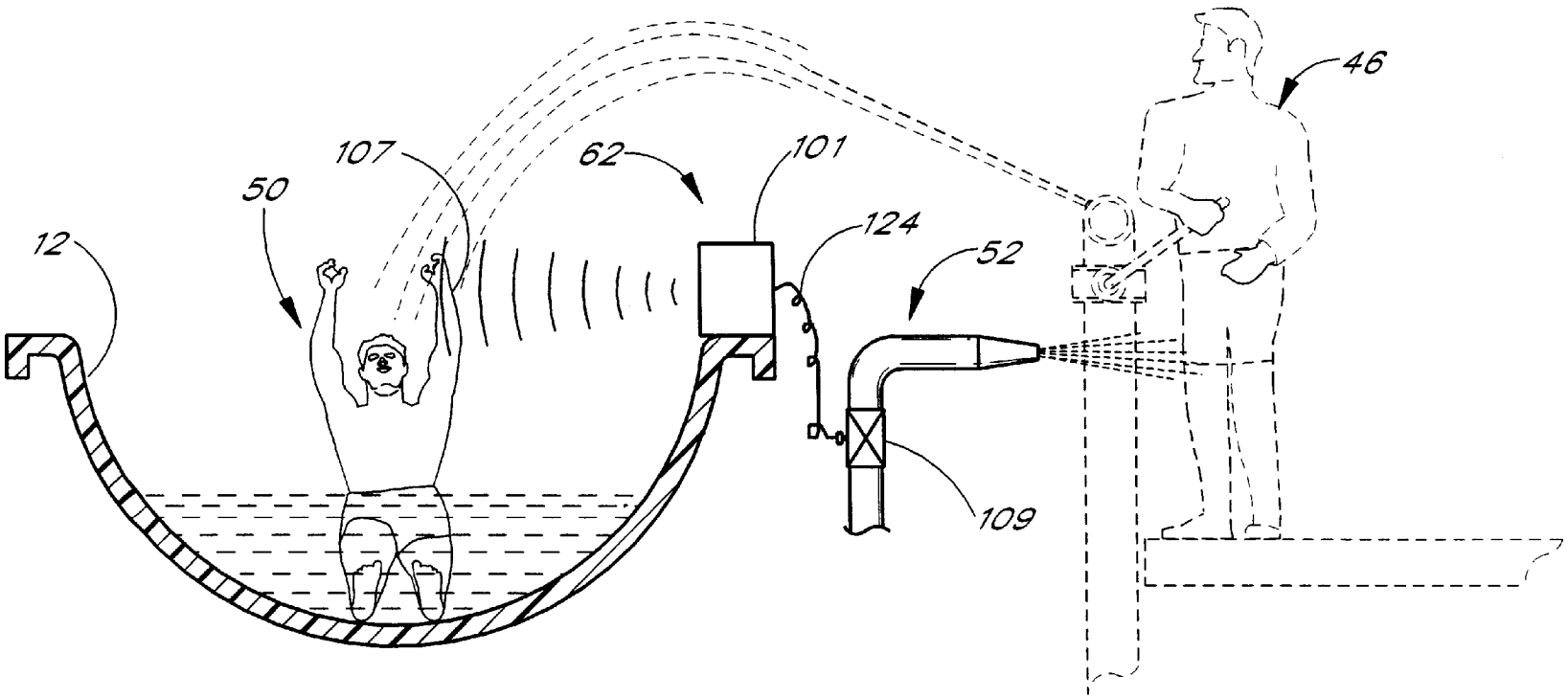
FIG. 3 is a simplified schematic illustration of one possible embodiment of a sensor/actuator device and associated water forming element having features in accordance with the present invention.

The participatory water slide play structure 100 includes additional water forming devices 52, 54, 56, 58 configured to be activated by specially adapted actuator/sensor devices 62, 64, 66, 68, 70, 72, 74 provided on or adjacent the riding surface 12, as shown. Thus, play participants sliding down the riding surface 12 can create desired play effects such as spraying water into the air and/or onto other play participants located on the adjacent climbing structure 18. In this manner, play participants sliding down the slide are able to "fight back" or exchange fire with other play participants on the climbing structure 18, such as illustrated in FIG. 3. Advantageously, this enables the play participants sliding down the slide to take an active role in creating desired water effects and/or other play effects while sliding down the slide, making the experience more enjoyable both for the ride participants and other play participants waiting in line and/or operating various other water forming elements. These play effects may include water effects or other play media effects, as desired. Suitable play media may include such diverse items as water, tennis balls, rubber balls, beach balls, balloon balls, frisbees, foam darts/arrows, snow, mud, water-balloons, slime, as well as a variety of other fun and exciting play media well known to those skilled in the art.

These features and advantages of the present invention are facilitated by several uniquely adapted sensor/actuator devices located at various positions along the riding surface 12 and which can be triggered or actuated by an individual traveling down the slide. Suitable sensor/actuator devices may include, for example and without limitation, a wide variety of sensors and/or actuators, such as noncontact photo sensors or beam sensors (e.g., visible light, ultra-violet, infra-red beams, and the like), audio sensors (e.g., audible sound sensors, ultrasonic sensors and the like), field sensors (e.g., tag sensing devices, bar code reading devices, and the like), target actuators or sensors (e.g., watergun targets, foam ball targets, frisbee targets, basket targets, and the like), and contact actuators or sensors (e.g., trip wires, weight sensors, flipper triggers, direct contact targets and the like).

The sensor/actuator devices can either be passive (i.e., requiring no effort by the ride participant) or active (i.e., requiring an affirmative act by the ride participant), as desired, and may either be activated by contact and/or noncontact means. The possibilities for various sensor/actuator devices in accordance with the present invention and the nature of their operation and the effects they create are limited only by the imagination of the play structure designer.

Contact sensor/actuator devices may include, for example and without limitation, various target sensors, flipper sensors, weight sensors and the like. These may be activated by physical contact with the ride participant's body or extremities, or they may be activated by an object thrown or directed by the ride participant as he or she rides down the riding surface. Noncontact sensor/actuator devices may include, for example and without limitation, such devices as laser beam sensors, proximity sensors, infrared sensors, photo sensors, motion detectors, signal sensors and the like. These may be activated by various noncontact means such as, without limitation, breaking an electronic and/or optical beam, making predetermined hand/waving motions, sliding on a specific portion of the riding surface, or bringing a ride participant's body, an extremity thereof or an associated electronic tag within a certain predetermined range or proximity of the sensorlactuator device.

In accordance with the present invention the various sensor/actuator devices may be used to activate various play elements in order to achieve desired play effects or to attain desired goals. The desired goals or play effects may be visual, aural or tactile in nature and may or may not involve the use of water or other suitable play mediums. Water forming play elements are shown and described herein for convenience of illustration only. Suitable water forming elements may include, for example and without limitation, a variety of spray nozzles, spray guns, overhead sprays, water falls and the like. Alternatively, suitable nonwater play elements may include, for example and without limitation, bells/buzzers, flashing lights, scoring mechanisms, targets, spinners, and the like.

The desired play effects or goals may be singular in scope or operation or they may involve many different play elements and/or play effects, such as progressive or cascading effects. The various play effects may be configured so as to be activated either by individual play participants or by a group of play participants cooperating to achieve the desired effect. Again, the possibilities for various play elements and/or play effects in accordance with the present invention are limited only by the imagination of the play structure designer.

Several particularly preferred embodiments of suitable sensor/actuator devices and associated play elements are described below. However, it should be apparent to those persons skilled in the art that a wide variety of alterative sensor/actuator devices and play elements may be used to practice the invention herein disclosed. The following examples are provided for purposes of illustration only and, therefore, should not be construed as limiting the invention in any way.

FIG. 3 is a simplified schematic illustration of one possible embodiment of a sensor/actuator device 62 and associated water forming element 52 having features in accordance with the present invention. The sensor/actuator device 62 comprises a proximity sensor 101 adapted to generate an actuating signal in response to a ride participant 50 placing a hand 107 or other bodily appendage within a predetermined proximity to the sensor 101. The actuating signal is conducted via one or more conductors, such as electrical conductor 124, to a solenoid valve 109 or other signal receiving means for controlling an associated play element, such as water forming element 52.

Those skilled in the art will appreciate that the solenoid valve 109 operates to open or close a valve in response to an actuating signal generated by the sensor/actuator device 62. When the valve is in its open position, water forming element 52 sprays water at a play participant 46 standing on an adjacent structure. When the valve is closed no water is sprayed by the water forming element 52. While a solenoid valve 109 is a convenient expedient in this case for controlling an associated play element, those skilled in the art will readily appreciate that a wide variety of other signal receiving means may be used to control one or more associated play elements, including, without limitation, various relays, springs, gears, hydraulic and/or pneumatic actuators or valves, and the like. Likewise, various actuating signals and signal-carrying conductors may also be used, including, without limitation, mechanical, electrical, optical, acoustic, hydraulic, pneumatic, or magnetic signals and conductors. If electrical conductors are used to transmit an actuating signal, it is preferred that the conductors and any associated circuitry be well isolated and/or operate with a sufficiently low voltage, such as 12 VDC, so as to avoid an electric shock hazard.

Figure 4:
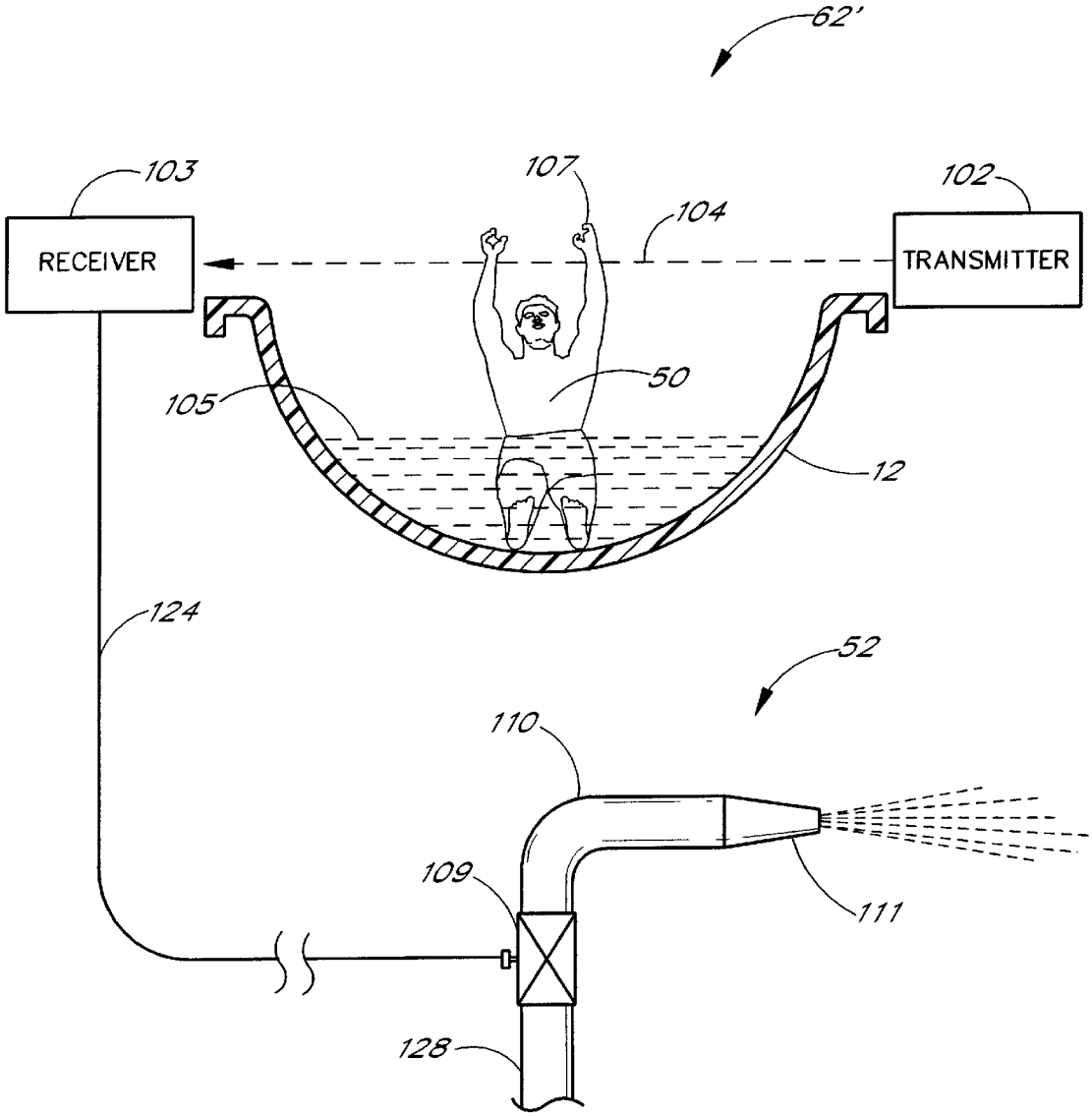
FIG. 4 is a simplified schematic illustration of another possible embodiment of a sensor/actuator device and associated water forming element having features in accordance with the present invention.

FIG. 4 is a simplified schematic illustration of another possible embodiment of a sensor/actuator device 62' and associated water forming element 52 having features in accordance with the present invention. In this case, the sensor/actuator device 62' is provided in the form of a beam sensor having a transmitter 102 and receiver 103. The transmitter 102 and receiver 103 are positioned as shown so as to create a substantially unobstructed sensing beam 104. The beam 104 may include a wide variety of beams and/or beam-like transmissions, including without limitation, electromagnetic, optical, laser, infrared, or ultrasonic beams, and/or various water spray patterns and the like.

The sensor/actuator device 62' is triggered when a ride participant 50 interrupts the sensing beam 104 with a bodily appendage, such as a hand 107. In that case the receiver 103 detects that the sensing beam 104 has been broken and, in response, generates an activating signal which is transmitted through one or more conductors, such as electrical conductor 124, to a solenoid valve 109. Again, the solenoid valve 109 is a convenient expedient for controlling an associated play element by opening or closing a valve in response to an actuating signal generated by the sensor/actuator device 62'. Those skilled in the art will readily appreciate that a wide variety of other signal receiving means may be used to control an associated play element, such as noted above, with or without the transmitter 102.

Upon receiving the actuating signal the solenoid valve 109 opens, allowing water to flow from pipe 128 into pipe 110 and out the jet nozzle 111 of the water forming element 52. Jet nozzle 111 is preferably positioned so that the water from jet nozzle 111 will spray in the direction of other play participants waiting in line on an adjacent climbing structure, such as illustrated in FIG. 3. Alternatively, the jet nozzle 111 can be directed into the air or at a target to create desired water effects or it can be directed onto the riding surface, at the ride participant or onto an adjacent riding surface or ride participant, as desired. Again, the possibilities for operating various play elements and play effects in accordance with the present invention are limited only by the imagination of the play structure designer.

Figure 5A:
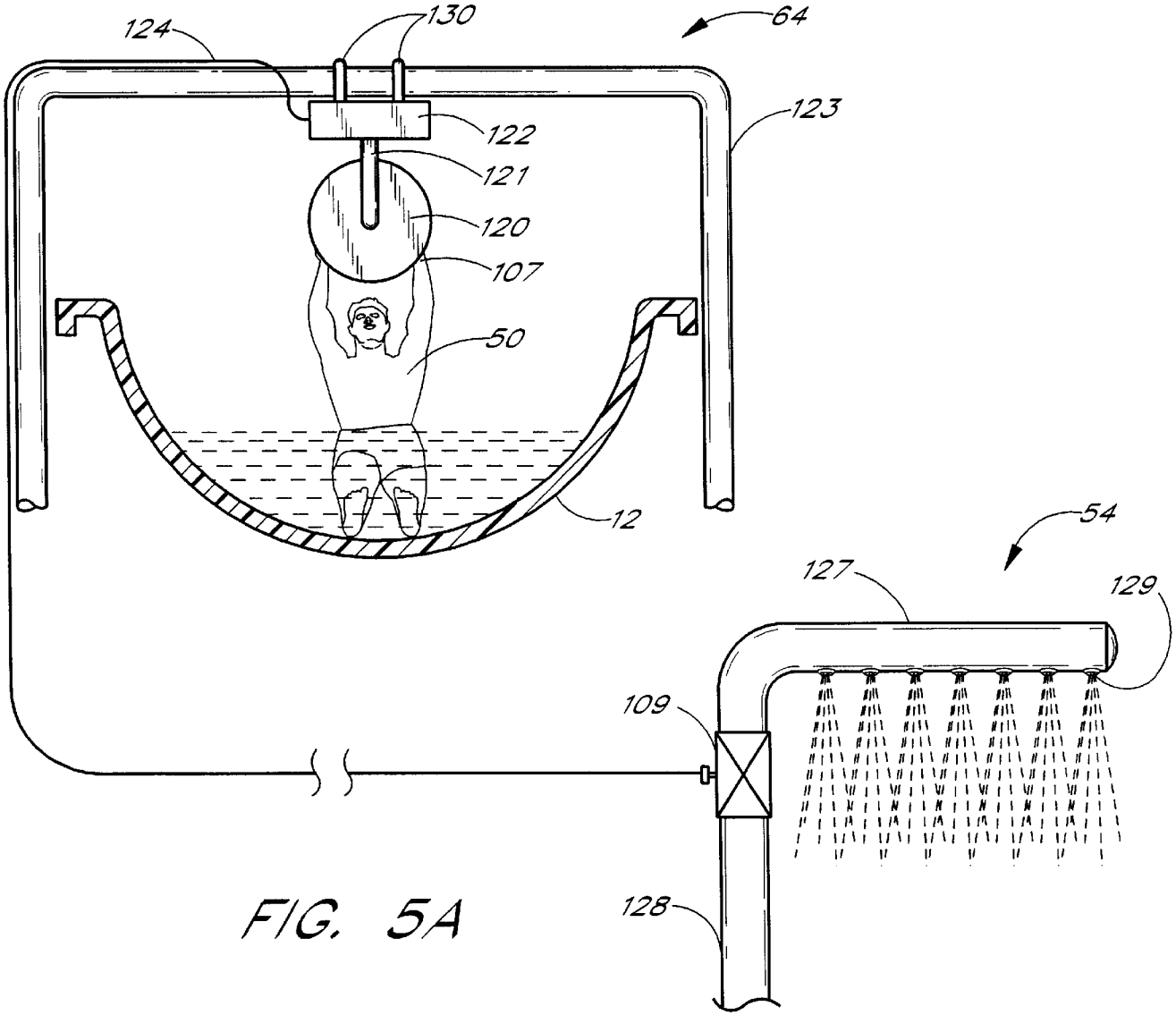
FIG. 5A is a simplified schematic illustration of another possible embodiment of a sensor/actuator device and associated water forming element having features in accordance with the present invention.
Figure 5B:
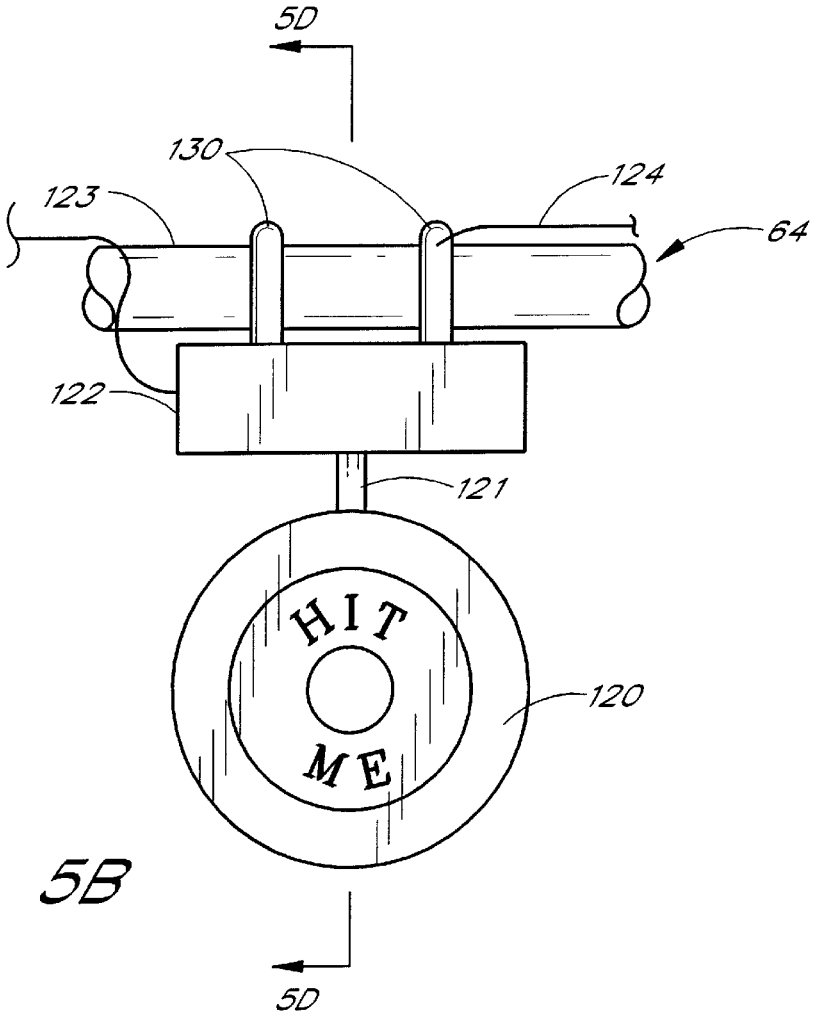
FIG. 5B is a front elevational view of the sensor/actuator device of FIG. 5A.
Figure 5C:
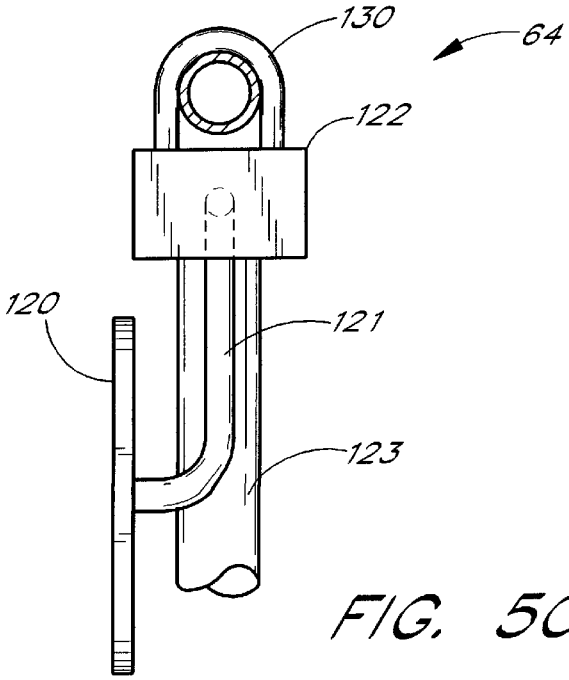
FIG. 5C is a side elevational view of the sensor/actuator device of FIG. 5A.

FIG. 5A is a simplified schematic illustration of another possible embodiment of a sensor/actuator device 64 and associated water forming element 54 having features in accordance with the present invention. In this case, sensor/actuator device 64 is provided in the form of a contact target 120. The target 120 is mounted on a rotatable shaft 121 coupled to a sensor box 122, as shown in FIGS. 5B–C. The entire assembly is mounted above the riding surface 12 such as by U-brackets 130 secured to an overhead bar 123. To actuate the sensor/actuator device 64, a ride participant 50 hits the target 120 with one or both hands 107, as shown.

Figure 5D:
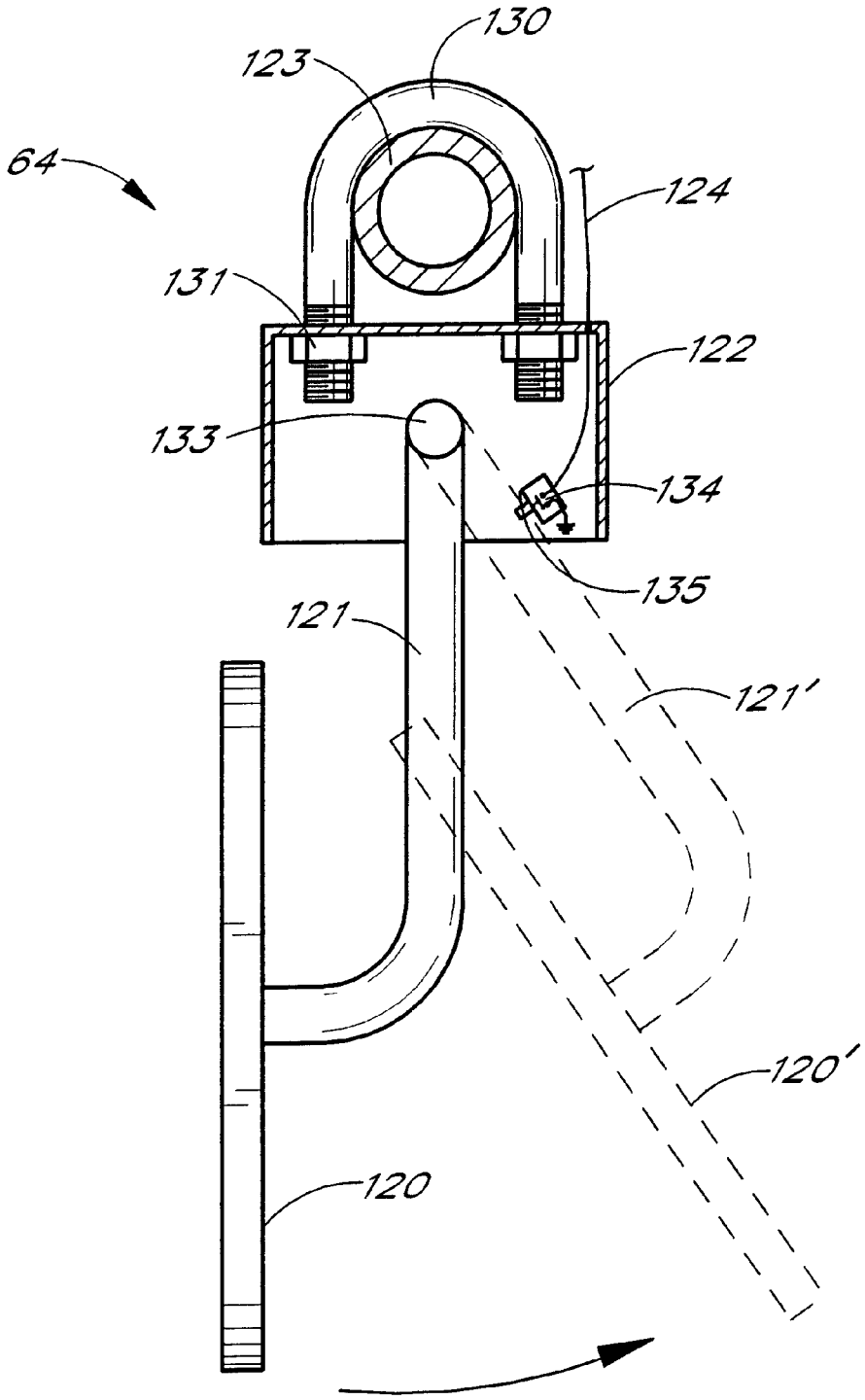
FIG. 5D is a simplified electromechanical schematic showing internal workings in accordance with one possible embodiment of the sensor/actuator device of FIG. 5A.

FIG. 5D is a simplified electromechanical schematic showing internal workings in accordance with one possible embodiment of the sensor/actuator device 64 of FIG. 5A. As shown in FIG. 5D, when the target 120 is contacted by a play participant, the target 120 and mounting shaft 121 rotate around a pivot 133, assuming new positions 120' and 121', respectively. At the end of this rotation, the mounting shaft 121' contacts and depresses a switch button 135, activating an associated switch 134. The switch 134 opens or closes a circuit, generating an activating signal.

The activating signal is conducted by a signal conductor, such as electrical conductor 124, to a solenoid valve 109 (FIG. 5A). The solenoid valve 109 is a convenient expedient for controlling an associated play element by opening or closing a valve in response to an actuating signal generated by the sensor/actuator device 64. Those skilled in the art will readily appreciate that a wide variety of other signal receiving means may be used to control an associated play element, such as noted above.

Upon receiving the actuating signal the solenoid valve 109 opens, allowing water to flow from pipe 128 into pipe 127 and out the spray jet nozzles 129 of the water forming element 54. Jet nozzles 129 are preferably positioned so that the water from jet nozzles 129 will spray down over other play participants waiting in line on an adjacent climbing structure, such as illustrated in FIG. 2. Alternatively, the jet nozzles 129 can be directed into the air or at a target to create desired water effects or it can be directed onto the riding surface, at the ride participant or onto an adjacent riding surface or ride participant, as desired.

It should be appreciated that actuator/sensor device 64 may be activated in a number of other ways, including but not limited to throwing objects such as foam or rubber balls or frisbees, by striking target 120 with hand-held objects such as plastic bats or rubber hammers, or by utilizing various projectile launching devices such as portable water guns or foam ball guns to direct a spray of water and/or other projectiles at the target 120.

Figure 6:
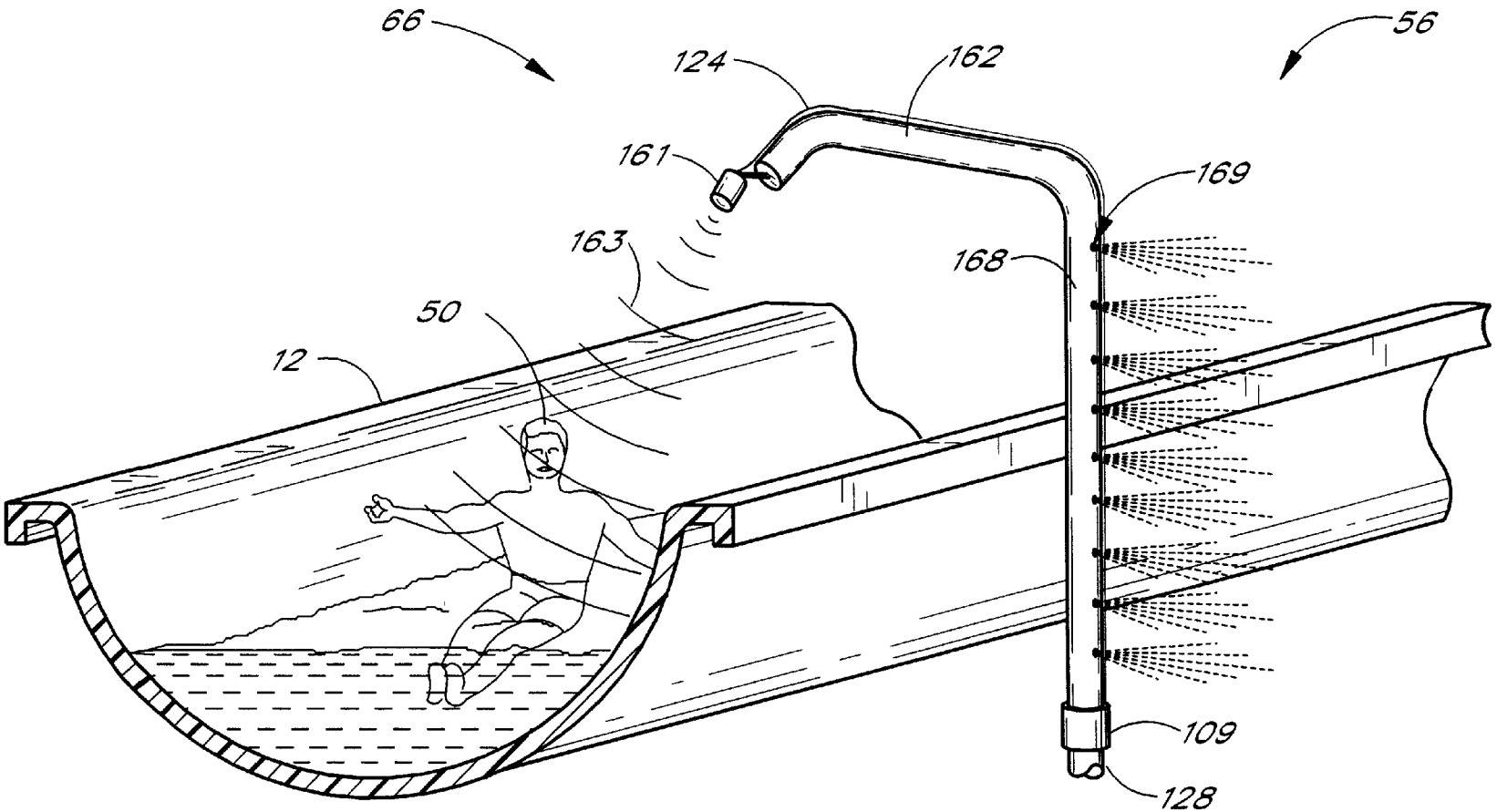
FIG. 6 is a simplified schematic illustration of another possible embodiment of a sensor/actuator device and associated water forming element having features in accordance with the present invention.

FIG. 6 is a simplified schematic illustration of another possible embodiment of a sensor/actuator device 66 and associated water forming element 56 having features in accordance with the present invention. In this case, the sensor/actuator device 66 is provided in the form of a motion detector 161, mounted above riding surface 12 on an overhead beam 162. The motion detector 161 may comprise any one of a variety of commercially available motion sensing devices well known to those skilled in the art, such as those used to automatically open and close doors in commercial buildings or to turn lights on or off. In one possible mode of operation, motion detector 161 emits a sensing beam 163 which is reflected back to motion detector 161 when an object, such as ride participant 50, enters the area of the sensing beam 163. The sensitivity of the motion detector 161 may be varied, as desired, to adjust the level of motion required to trigger the motion detector 161 (e.g., requiring ride participants to wave their hands to activate the motion detector). Alternatively, the motion detector 161 may comprise an infrared sensor which senses the body heat of a ride participant.

Upon activation, motion detector 161 generates an activating signal which is transmitted through one or more conductors, such as electrical conductor 124, to a solenoid valve 109. Again, the solenoid valve 109 is simply a convenient expedient for controlling an associated play element by opening or closing a valve in response to an actuating signal generated by the sensor/actuator device 66. Those skilled in the art will readily appreciate that a wide variety of other signal receiving means may be used to control an associated play element, such as noted above.

Upon receiving the actuating signal the solenoid valve 109 opens, allowing water to flow from pipe 128 into pipe 168 and out the spray jet nozzles 169 of the water forming element 56. Jet nozzles 169 are preferably positioned so that the water from jet nozzles 169 will spray in the direction of other play participants waiting in line on an adjacent climbing structure, such as illustrated in FIG. 2. Alternatively, the jet nozzles 169 can be directed into the air or at a target to create desired water effects or it can be directed onto the riding surface, at the ride participant or onto an adjacent riding surface or ride participant, as desired.

Again, it should be appreciated that actuator/sensor device 66 may be activated in other ways, including but not limited to throwing objects such as foam or rubber balls or frisbees, by waiving hand-held objects such as plastic bats or rubber hammers, or by utilizing various projectile launching devices such as portable water guns or foam ball guns to direct a spray of water and/or other projectiles at the motion detector 161.

Figure 7A:
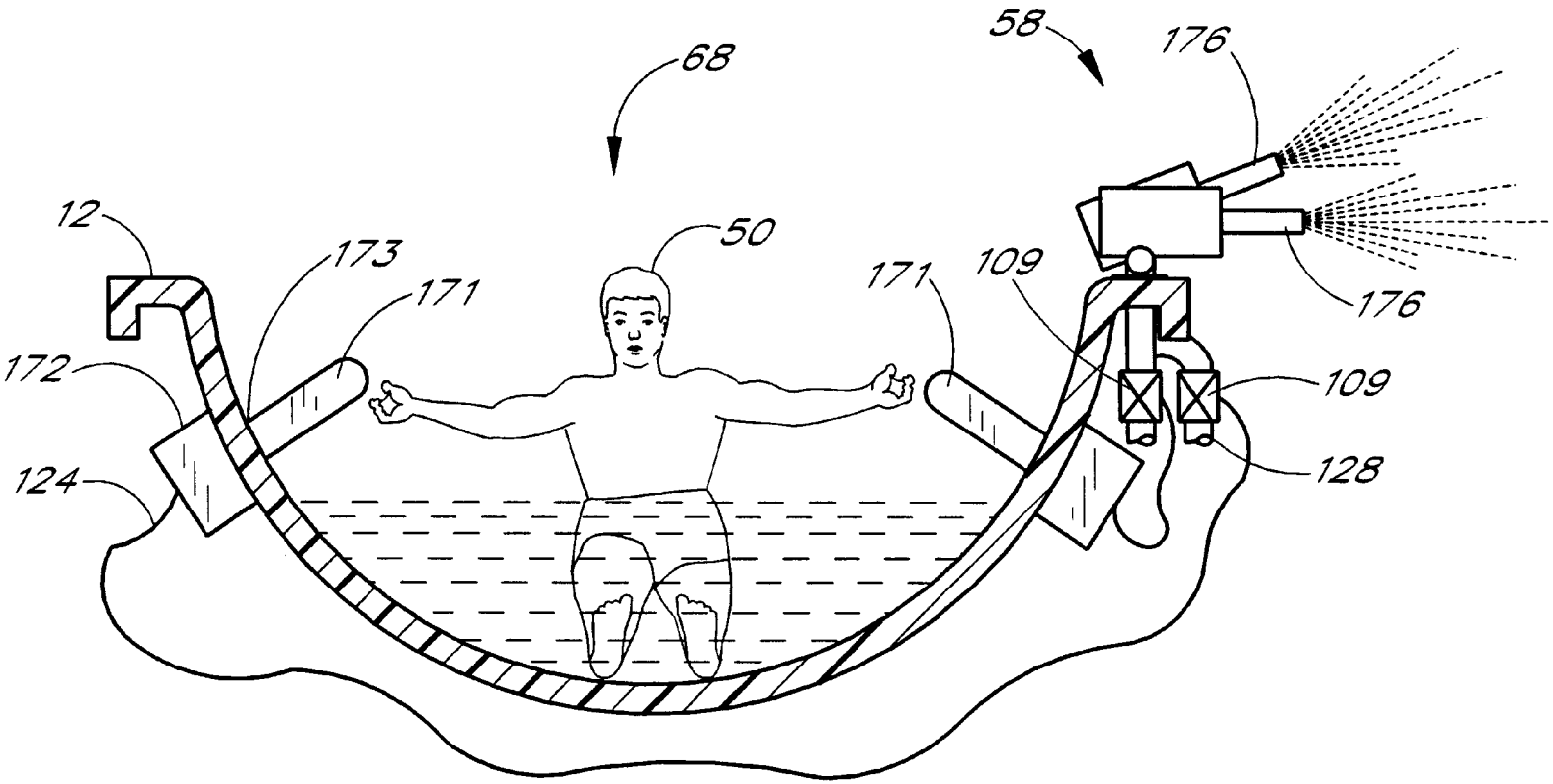
FIG. 7A is a simplified schematic illustration of another possible embodiment of a sensor/actuator device and associated water forming element having features in accordance with the present invention.

FIG. 7A is a simplified schematic illustration of another possible embodiment of a sensor/actuator device 68 and associated water forming element 58 having features in accordance with the present invention. In this case, the sensor/actuator device 66 is provided in the form of one or more contact actuators having flipper-like levers 171 extending from flipper sensor box 172 and which may, for example, extend through corresponding openings 173 formed in the wall of the riding surface 12. The flipper-like levers 171 are arranged such that as ride participant 50 travels down riding surface 12, he or she can selectively activate one or both sensor/actuator devices 68 by contacting one or both of the corresponding flippers 171.

Figure 7B:
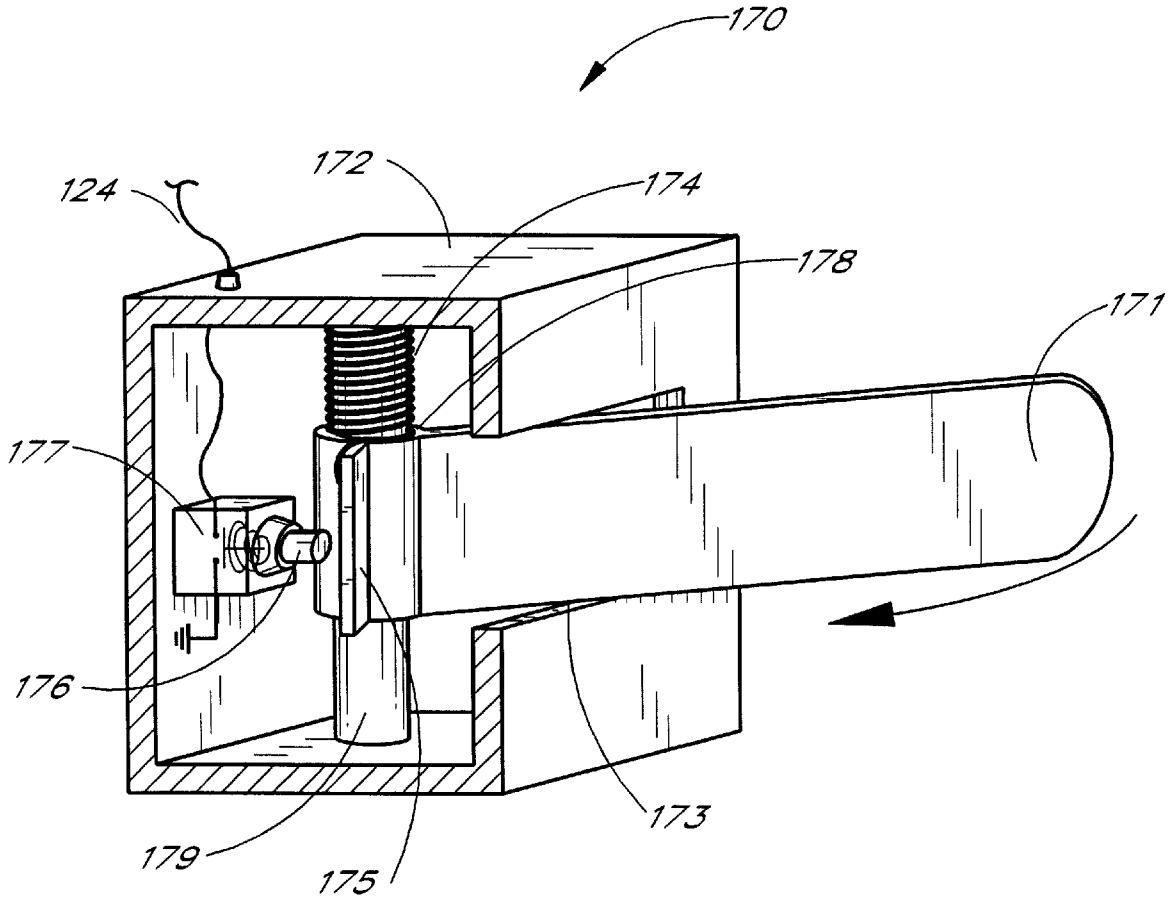
FIG. 7B is a simplified electromechanical schematic showing internal workings in accordance with one possible embodiment of the sensor/actuator device of FIG. 7A.

FIG. 7B is a simplified electromechanical schematic showing internal workings in accordance with one possible embodiment of the sensor/actuator device 68 of FIG. 7A. As shown in FIG. 7B, when the flipper 171 is contacted by a play participant 50, the flipper 171 rotates around a shaft 179. At the end of this rotation, a lever 175 contacts and depresses a switch button 176, activating an associated switch 177. The switch 177 opens or closes a circuit, generating an activating signal.

The activating signal is conducted by a signal conductor, such as electrical conductor 124, to one or more solenoid valves 109 (FIG. 7A). Again, solenoid valves 109 are a convenient expedient for controlling an associated play element 58 by opening or closing a valve in response to an actuating signal generated by the sensor/actuator device 68. Those skilled in the art will readily appreciate that a wide variety of other signal receiving means may be used to control an associated play element, such as noted above.

Upon receiving an actuating signal the solenoid valve 109 opens, allowing water to flow from pipe 128 to the spray guns 176. Spray guns 176 may be aimed at other play participants waiting in line on an adjacent climbing structure, such as illustrated in FIG. 2. Alternatively, the spray guns 176 can be directed into the air or at one or more targets to create desired water effects or they can be directed onto the riding surface, at the ride participant or onto an adjacent riding surface or ride participant, as desired.

The flippers 171 are preferably thin and lightweight so as to be safe for use on the riding surface. They may be made of a variety of rigid, semi-rigid or flexible materials, including, but not limited to plastic, rubber, foam, and the like. The flippers are preferably spring biased via a spring 174 (FIG. 7B) in order to return the flippers 171 to their original position after being contacted by a ride participant. It should also be appreciated that the sensor actuator 68 can be configured such that each flipper 171 activates a corresponding spray gun 176, or it can be configured to require that both flippers be contacted by the participate in order to activate one or more of the spray guns 176, as desired.

Figure 8A:
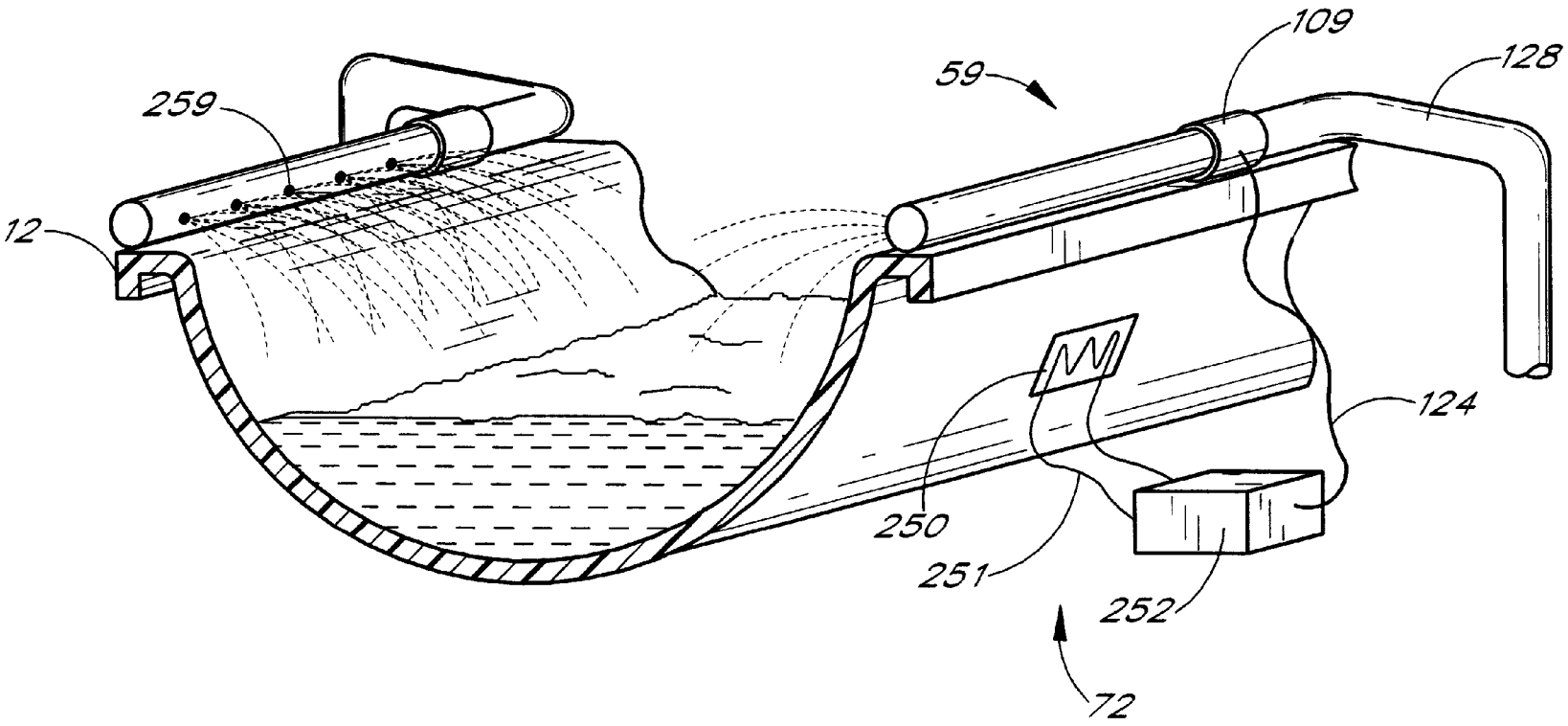
FIGS. 8A and 8B are simplified schematic illustrations of another possible embodiment of a sensor/actuator device and associated water forming element having features in accordance with the present invention.

FIG. 8A is a simplified schematic illustration of another possible embodiment of a sensor/actuator device 72 and associated water forming element 59 having features in accordance with the present invention. In this case, the sensor/actuator device 72 is provided in the form of a weight sensitive actuator device comprising a strain gauge 250, which is mounted on the riding surface 12 at a particular desired point or location. The strain gauge 250 is connected to strain sensor 252 via electrical conductors 251. When a ride participant passes down riding surface 12 in sufficient proximity to strain gauge 250, the mass and/or weight of the ride participant causes the riding surface 12 to experience a degree of deformation. This deformation alters the resistivity of the strain gauge 250, a difference which can be detected by the strain sensor 252. When sufficient deformation occurs, strain sensor 252 generates an activating signal.

The activating signal is conducted by a signal conductor, such as electrical conductor 124, to a solenoid valve 109. Again, the solenoid valve 109 is simply a convenient expedient for controlling an associated play element by opening or closing a valve in response to an actuating signal generated by the sensor/actuator device 72. Those skilled in the art will readily appreciate that a wide variety of other signal receiving means may be used to control an associated play element, such as noted above.

Upon receiving the actuating signal the solenoid valve 109 opens, allowing water to flow from pipe 128 and out the spray jet nozzles 259 of the water forming element 59. Jet nozzles 259 are preferably positioned so that the jet nozzles 259 inject water onto the riding surface 112 or at the ride participant, as desired. Alternatively, the jet nozzles 259 can be directed into the air or at a target to create desired water effects or it can be directed at other play participants waiting in line or sliding down the same slide or another slide.

It should be noted that strain gauge 250 need not be directly attached to riding surface 12, but may be placed on any support or other structure that experiences some deformation when a ride participant passes down the riding surface. In addition, such strain gauges and associated equipment may also be used in conjunction with various other contact actuator devices, such as the flipper-type contact actuator device described above in connection with FIG. 7, to detect when a force is applied to the device. For example, the flippers 171 could be constructed of a flexible material with a strain gauge attached to some portion of the flipper. Such structure could have advantage, for example, in eliminating electrical contacts which could otherwise corrode if exposed to chlorinated water.

If desired, weight sensitive actuator devices may be calibrated to selectively activate or deactivate various play elements or play effects according to the weight of the ride participant passing down the riding surface 12. In the case of smaller ride participants, for example, it may be desirous to lessen the volume or pressure of water, or intensity of a certain play effect or to disable it altogether, while still allowing for normal operation of the play elements or play effects for ride participants of larger size.

Figure 8B:
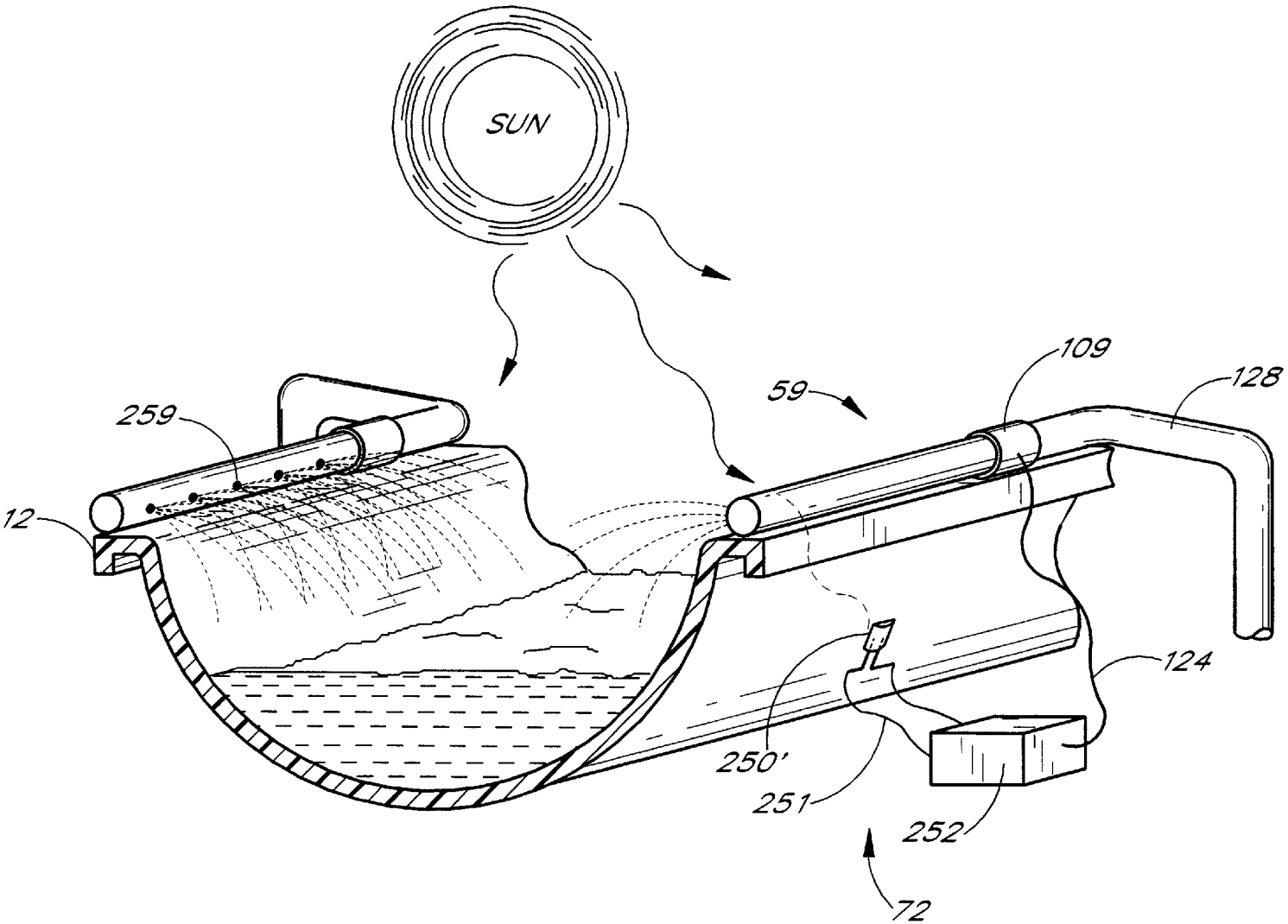

Attentively, the strain gauge 250 could be replaced with a photo-sensitive diode sensor, as illustrated in FIG. 8B. For example, the photo-sensitive diode 250 could be mounted behind a translucent portion of the ride surface. The diode would produce a certain signal level in response to ambient light, such as sunlight. However, if the diode is obstructed, such as by the hand of a ride participant blocking ambient light from the photo diode, the diode would produce a different signal level which could be detected in order to trigger the associated solenoid value 109.

Figure 9:
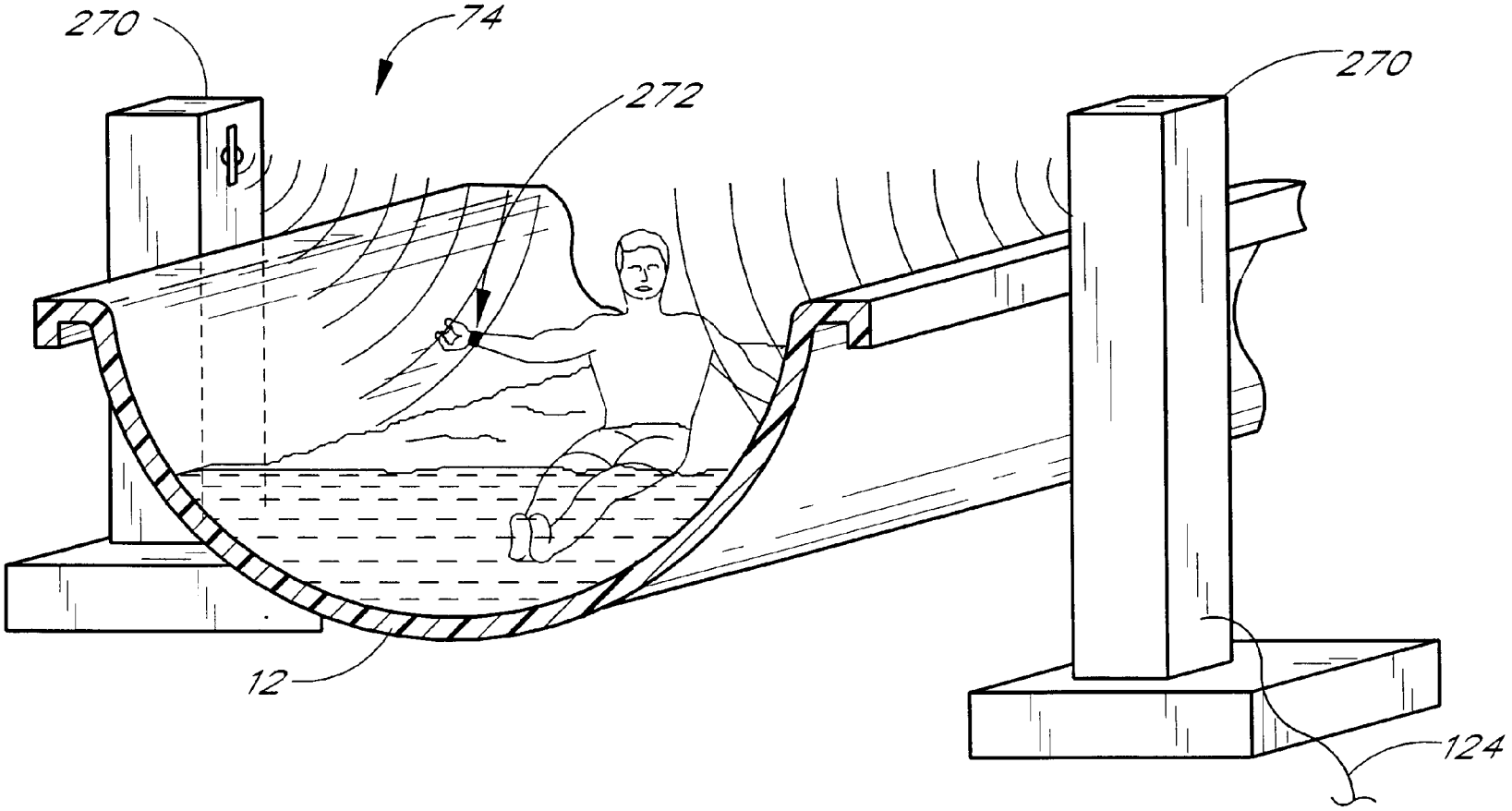
FIG. 9 is a simplified schematic illustration of another possible embodiment of a sensor/actuator device having features in accordance with the present invention.

FIG. 9 is a simplified schematic illustration of another possible embodiment of a sensor/actuator device 74 having features in accordance with the present invention. In this case, the sensor/actuator device 74 is provided in the form of an electronic tag sensor 270 provided in proximity to riding surface 12 for detecting a tag device 272 carried by a ride participant 50. Tag sensor 270 and tag device 272 may be similar to electronic bar code readers, or sensor devices commonly used to prevent theft of merchandise in stores. In operation, when tag device 272 passes within the sensing field of the tag sensor 270 the sensor 270 generates a signal which is transmitted via a signal conductor, such as electrical conductor 124. This signal may either be an activating signal, as described above, or, more preferably, it may be signal which contains certain information relating to the tag 272 which is sensed.

For example, the tag device 272 could have certain identifying information which allow them to be tracked for purposes of keeping track of point scoring, ride duration, ride payment information, or other desired information. The tag devices 272 may be carried by the ride participant 50 in a number of ways. For example, and not by way of limitation, the tag device may be implanted in a disposable wristband, may be carried in a small necklace or pendant, or can be directly secured to the ride participant's skin by adhesive or the like. The tag device may also be attached to the ride participant's clothing, or may be incorporated into a ride vehicle or mat upon which the ride participant rides while sliding down the riding surface 12. Various combinations of tag devices and/or other actuator devices could also be utilized to selectively activate or deactivate associated play devices or play effects on the water slide.

For example, the ride may be configured so that ride participants may choose the level and/or intensity of interactive participation they desire during their ride. Certain ride participants may desire to ride down the slide without participating in the participatory play aspects as disclosed herein. In the case of small children, for example, it may be desirable to provide an identifying tag or device which could allow selective activation or deactivation of certain play elements or play effects along the ride in order to ensure the safety of young ride participants. Advantageously, this enables the ride to be temporarily toned down for younger ride participants, without affecting the level of participatory play and enjoyment of previous or subsequent ride participants.

In alternative embodiments, the ride may be configured so that ride participants can participate in individual or team scoring. During the ride down the riding surface, for example, whenever a ride participant completes a task or brings about a desired effect, the ride participant or team of ride participants may be accorded points for successful completion of the task. By tracking the ride participants' scores, displaying the highest scores achieved, and/or providing the ride participant with additional "ammunition" or ride time upon successful completion of each task, the subject invention provides a competitive impetus for repetitively riding the water slide, so that ride participants can develop their skills and earn even higher scores on subsequent rides down the slide. Points and scoring can be tracked from ride participant to ride participant or from group to group using electronic tags and/or sensors as described above or by other means as will be readily apparent to persons skilled in the art, such as electronic or magnetic cards, tracking numbers, PIN codes and the like.

Ride participants can also be challenged to complete various tasks or desired goals as they slide down the riding surface. By providing tasks with progressive or designated point scoring, competitive games, team competition and/or league play is made possible, adding to the overall excitement of the attraction. Alternatively, team members may be positioned at various locations along the riding surface, and may operate various water forming devices in order to accelerate themselves or other ride participant or assist the ride participant in scoring points or completing tasks. Thus, each team member feels that they are participating in each level of the competition, all contributing toward the final team score. Opposing team members may be provided with similar water forming devices, allowing them to hinder the ride participant's and opposing team members' attempts to gain higher scores or complete designated tasks. A variety of other applications having similar advantages will be readily apparent to those persons skilled in the art.

This invention has been disclosed and described in the context of various preferred embodiments. It will be understood by those skilled in the art that the present invention extends beyond the specific disclosed embodiments to other alternative possible embodiments. Thus, it is intended that the scope of the present invention herein disclosed should not be limited by the disclosure and drawings contained herein, except as encompassed by a fair reading of the claims which follow.

I claim:

1. A participatory slide play structure comprising:

a riding surface upon which a first group of one or more play participants can slide along an expected path;

one or more associated effect-delivering play elements adapted to create desired effects on a second group of play participants or adapted and positioned to shoot water and/or other play media at a second group of participants; and one or more sensor/actuator devices comprising one or more of the following devices: a noncontact actuator, target actuator, photo-sensitive actuator, motion sensor, proximity sensor, audio sensor, beam sensor, infrared sensor, electronic tag sensor, weight sensor, lever/flipper actuator, basket sensor, for activating one or more of the associated play elements, the sensor/actuator devices positioned at locations relative to the riding surface to allow the first group of one or more play participants sliding upon the riding surface along an expected path to safely actuate the sensor/actuator devices.

2. The slide play structure of claim 1 wherein the riding surface is lubricated with a flow of water to form a water slide.

3. The slide play structure of claim 1 wherein at least one of the play elements comprises a water play element for creating desired water effects and/or for spraying water at various targets or other participants.

4. The slide play structure of claim 3 wherein the water play element comprises a nozzle adapted to spray a stream of water.

5. The slide play structure of claim 3 wherein the water play element comprises a water fall.

6. The slide play structure of claim 1 wherein at least one of the play elements comprises a noise making device.

7. The slide play structure of claim 1 wherein at least one of the play elements comprises flashing lights.

8. The slide play structure of claim 1 wherein at least one of the play elements comprises a score board or other scoring device.

9. The slide play structure of claim 1 wherein at least one of the play elements comprises a target or spinner.

10. The slide play structure of claim 1 wherein the sensor/actuator device comprises a contact actuator disposed on or adjacent the riding surface for allowing participants to selectively actuate one or more of the play elements as the participants slide along the riding surface along an expected path.

11. The slide play structure of claim 1 wherein the sensor/actuator device comprises a noncontact actuator disposed on or adjacent the riding surface for allowing participants to selectively actuate one or more of the play elements as the participants slide along the riding surface along an expected path.

12. The slide play structure of claim 1 wherein the sensor/actuator device comprises a target actuator disposed on or adjacent the riding surface for allowing participants to selectively actuate one or more of the play elements by striking a target as the participants slide along the riding surface along an expected path.

13. A participatory slide play structure as in claim 1, wherein the sensor/actuator device is located directly above the riding surface.

14. A participatory slide play structure comprising:

a riding surface upon which play participants can slide;

one or more associated play elements for creating desired effects and/or for achieving a desired goal; and means for activating one or more of the associated play elements, the sensor/actuator devices positioned at locations relative to the riding surface to allow play participants sliding along the riding surface to safely actuate the sensor/actuator devices;

wherein the riding surface is at least partially translucent and wherein the sensor/actuator device comprises a photo-sensitive diode sensor disposed underneath or adjacent the riding surface for actuating one or more of the play elements as the participants selectively block ambient light impinging upon the diode sensor.

15. A participatory slide play structure comprising:

a riding surface upon which a first group of one or more participants can slide from an entrance point to an exit point along an expected path;

a support structure disposed adjacent the riding surface adapted to support a second group of one or more participants, the support structure being sized and configured such that the second group of participants can view the first group of participants as they slide along the riding surface; and one or more play elements for creating desired effects or for shooting water and/or other play media at the second group of participants, the one or more play elements positioned at locations relative to the ride surface to allow the first group of participants to safely actuate the play elements as they slide along the riding surface along an expected path, whereby the first group of participants can actively engage in various participatory activities as they slide along the riding surface along an expected path.

16. The slide play structure of claim 15 wherein at least one of the play elements comprises a water nozzle adapted to spray a stream of water at a target or other participants.

17. The slide play structure of claim 15 wherein at least one of the play elements comprises a target or spinner.

18. The slide play structure of claim 15 wherein at least one of the play elements comprises a score board or other scoring device.

19. The slide play structure of claim 15 further comprising one or more sensor/actuator devices disposed on or adjacent the riding surface for actuating one or more of the play elements as the participants slide along the riding surface.

20. The slide play structure of claim 19 wherein the sensor/actuator device comprises a contact actuator disposed on or adjacent the riding surface.

21. The slide play structure of claim 19 wherein the sensor/actuator device comprises a noncontact actuator disposed on or adjacent the riding surface.

22. The slide play structure of claim 19 wherein the riding surface is at least partially translucent and wherein the sensor/actuator device comprises a photosensitive diode sensor disposed underneath or adjacent the riding surface and adapted to actuate one or more of the play elements as the participants selectively block ambient light impinging upon the diode sensor.

23. A participatory slide play structure as in claim 15, wherein at least one of the play elements is mounted on or adjacent the riding surface and is positioned such that it can be actuated by the first group of participants, and cannot be actuated by the second group of participants.

24. A riding surface having a trigger mechanism for allowing participants sliding along the riding surface to activate one or more associated play effects, said trigger mechanism comprising:

a sensor/actuator device sized and configured to be disposed on or adjacent the riding surface and adapted to generate an actuating signal when actuated, the sensor/actuator device being positioned at a location relative to the riding surface to allow participants sliding along the riding surface to use positioning of their bodies or other affirmative acts to selectively actuate or avoid actuating the sensor/actuator device; and a receiver/controller device for receiving the actuating signal and for generating a control signal to control one or more associated play effects;

whereby participants sliding down the riding surface are able to actively engage in various participatory activities as they slide along the riding surface.

25. The riding surface of claim 24 wherein the sensor/actuator device comprises a noncontact sensor.

26. The riding surface of claim 25, further comprising a photo-sensitive diode sensor and a translucent portion of said riding surface, the photo-sensitive diode sensor disposed underneath or adjacent the translucent portion of the riding surface such that participants can selectively block ambient light impinging upon the diode sensor, thereby activating an associated play effect.

27. The riding surface of claim 25 wherein the sensor/actuator device comprises a motion sensor, proximity sensor, audio sensor, beam sensor, infrared sensor or electronic tag sensor.

28. The riding surface of claim 24 wherein the sensor/actuator device comprises a contact sensor.

29. The riding surface of claim 24 wherein the sensor/actuator device comprises a weight sensor, lever/flipper actuator, target sensor, or basket sensor.

30. The riding surface of claim 24 wherein the receiver/controller device comprises an electronic solenoid valve adapted to control the flow of water to an associated water play element directed at a group of one or more observers of the participants sliding along the riding surface.

31. A riding surface having a trigger mechanism for allowing participants sliding along a riding surface to activate one or more associated play effects, comprising a photo sensitive diode sensor and a translucent portion of the ride surface, the diode sensor and translucent portion positioned at a location relative to the riding surface such that participants sliding along the riding surface can selectively block or avoid blocking ambient light impinging upon the diode sensor to selectively generate an actuating signal or avoid generating an actuating signal.

32. The riding surface of claim 31 her comprising a receiver/controller device for receiving the actuating signal and for generating a control signal to control one or more associated play effects whereby participants sliding down the riding surface are able to actively engage in various participatory activities as they slide along the riding surface.

33. A riding surface for a slide play structure, the riding surface being formed of a fiberglass material and substantially smooth on at least one side thereof, the riding surface further comprising at least one sensor/actuator device positioned relative to the riding surface such that a ride participant sliding along the riding surface can selectively actuate one or more associated play elements as the participant slides along the riding surface;

wherein the fiberglass material is translucent over at least a portion thereof and wherein the sensor/actuator device comprises a photo-sensitive diode sensor disposed opposite the smooth side of the riding surface and arranged such that participants sliding along the riding surface can selectively block ambient light impinging upon the diode sensor.

34. A riding surface for a slide play structure, the riding surface being substantially smooth on at least one side thereof, the riding surface further comprising at least one sensor/actuator device positioned relative to the riding surface such that a ride participant sliding along the riding surface can selectively actuate one or more associated play elements as the participant slides along the riding surface;

wherein the riding surface further comprises a window formed therein or a transparent or translucent material behind which a photo-sensitive diode sensor is disposed, the diode sensor being arranged such that participants sliding along the riding surface can selectively block ambient light impinging upon the diode sensor.

35. The riding surface of claim 34, wherein the photo-sensitive diode sensor is positioned relative to the riding surface so that the ride participant sliding along the riding surface must affirmatively position his arms and/or legs in order to selectively block ambient light impinging upon the sensor.

36. The riding surface of claim 34, wherein the ride participant slides along the riding surface along an expected path, and the window is disposed at least partially within the expected path.

37. A participatory water slide play structure comprising:

a riding surface upon which participants can slide, the riding surface being formed of a fiberglass material and being substantially smooth on at least one side thereof;

a plurality of associated water play elements disposed on, adjacent to, or remote from the riding surface, for creating desired water effects and/or for spraying water at various targets or other participants;

a plurality of photo-sensitive diode sensors positioned behind the riding surface and arranged such that participants sliding along the ride surface can selectively block ambient light impinging upon the diode sensor to generate an actuating signal; and a plurality of solenoid actuated valves and/or other circuitry for receiving the actuating signal and, in response, controlling the flow of water provided to one or more of the plurality of associated water play effects.

38. A participatory slide play structure comprising:

a riding surface upon which play participants can slide;

one or more associated play elements for creating desired effects and/or for achieving a desired goal; and one or more sensor/actuator devices for activating one or more of the associated play elements, the sensor/actuator devices positioned at locations relative to the riding surface to allow play participants sliding along the riding surface to safely actuate the sensor/actuator devices;

wherein the sensor/actuator device is in contact with the riding surface.

39. The slide play structure of claim 38, wherein the sensor/actuator device is positioned such that the play participant sliding along the riding surface can avoid actuating the sensor/actuator device.

40. A participatory slide play structure comprising:

a riding surface upon which play participants can slide;

one or more associated play elements for creating desired effects and/or for achieving a desired goal; and one or more sensor/actuator devices for activating one or more of the associated play elements, the sensor/actuator devices positioned at locations relative to the riding surface to allow play participants sliding along the riding surface to safely actuate the sensor/actuator devices;

wherein the sensor/actuator device is located directly below the riding surface.

41. A participatory slide play structure comprising:

a riding surface upon which play participants can slide;

one or more associated play elements for creating desired effects and/or for achieving a desired goal; and one or more sensor/actuator devices for activating one or more of the associated play elements, the sensor/actuator devices positioned at locations relative to the riding surface to allow play participants sliding along the riding surface to safely actuate the sensor/actuator devices;

wherein the sensor/actuator device is located within three feet of the riding surface.

42. The slide play structure of claim 41, additionally comprising a platform adjacent the riding surface and adapted to support a second group of play participants thereon wherein the sensor/actuator device is positioned out of reach of the second group of play participants on the platform.

43. The slide play structure of claim 41, wherein the sensor/actuator device is positioned relative to the riding surface so that the play participants sliding along the riding surface can avoid actuating the sensor/actuator device.

* * * * *